US006053460A

United States Patent [19]

Wilkinson, Jr. et al.

[11] Patent Number: 6,053,460

[45] Date of Patent: Apr. 25, 2000

[54] DISPLAY PANELS FOR RETAIL MERCHANDISE FIXTURES

[76] Inventors: E. Lee Wilkinson, Jr., 4113 31st Ave. #1, Cincinnati, Ohio 45209; Edgar L. Wilkinson, 7207 Miami Hills Dr., Cincinnati, Ohio 45243

[21] Appl. No.: 09/172,316

[22] Filed: Oct. 14, 1998

[51] Int. Cl.[7] ..... A47F 5/00; A47F 7/00; A47B 43/00

[52] U.S. Cl. ..... 248/122.1; 211/204; 211/193

[58] Field of Search ..... 248/188.8; 211/189, 211/204, 190, 193, 162, 187; 312/242, 204, 234

[56] References Cited

U.S. PATENT DOCUMENTS

| | | | |
|---|---|---|---|
| 2,991,889 | 7/1961 | Levy et al. | 211/190 |
| 3,160,281 | 12/1964 | Ruhnke | 52/234 |
| 3,297,374 | 1/1967 | Radek | 108/108 |
| 3,971,477 | 7/1976 | Bruderly et al. | 211/189 |
| 4,046,083 | 9/1977 | Murdoch et al. | 108/107 |
| 4,093,078 | 6/1978 | Radek | 211/189 |
| 4,186,666 | 2/1980 | Honickman | 108/29 |
| 4,253,578 | 3/1981 | Rekow | 211/208 |
| 4,326,637 | 4/1982 | James | 211/175 |
| 4,380,298 | 4/1983 | Harig | 211/189 |
| 4,415,090 | 11/1983 | Bustos | 211/49 |
| 4,508,231 | 4/1985 | Honickman | 211/199 |
| 4,944,416 | 7/1990 | Petersen et al. | 211/87 |
| 5,048,701 | 9/1991 | Simpson | 211/189 |
| 5,167,191 | 12/1992 | Muth | 108/108 |

*Primary Examiner*—Anita M. King
*Assistant Examiner*—Michael Nornberg
*Attorney, Agent, or Firm*—Edmund S. Lee, III

[57] ABSTRACT

A display panel for use in combination with a merchandise fixture, having a plurality of hanger arms on which a garments, or other merchandise can be hung by conventional hangers. The display panel is secured to the outer end of a hanger arm, with its width dimension disposed in a plane normal to the length of the hanger arm. The display panel has a projecting peg on which a sample of the merchandise may be hung. The display panel is connected to the hanger arm, by mechanism which includes a U-shaped bracket. The hanger arm is connected to the bracket by being captured between vertically and horizontally adjustable bolts, mounted on the bracket. Alternatively, the hanger arm may be secured by being clamped against a fixed abutment on the bracket. The lower end of the display panel may be positioned in an upright position by a position plate that is relatively thin and underlies a portion of the fixture. The positioning plate in one embodiment, in connected to the display panel by a hinge. In another embodiment, the positioning plate is connected to the display panel by separable, pins and sockets, that permit use of positioning plates that are customized for a given fixture. A positioning arm can be used as an alternative to the positioning plate. The positioning arm is pivotally mounted on the display panel and is provide with a recess that is received by a bar on the fixture in providing the positioning function.

21 Claims, 7 Drawing Sheets

PRIOR ART fig. 9
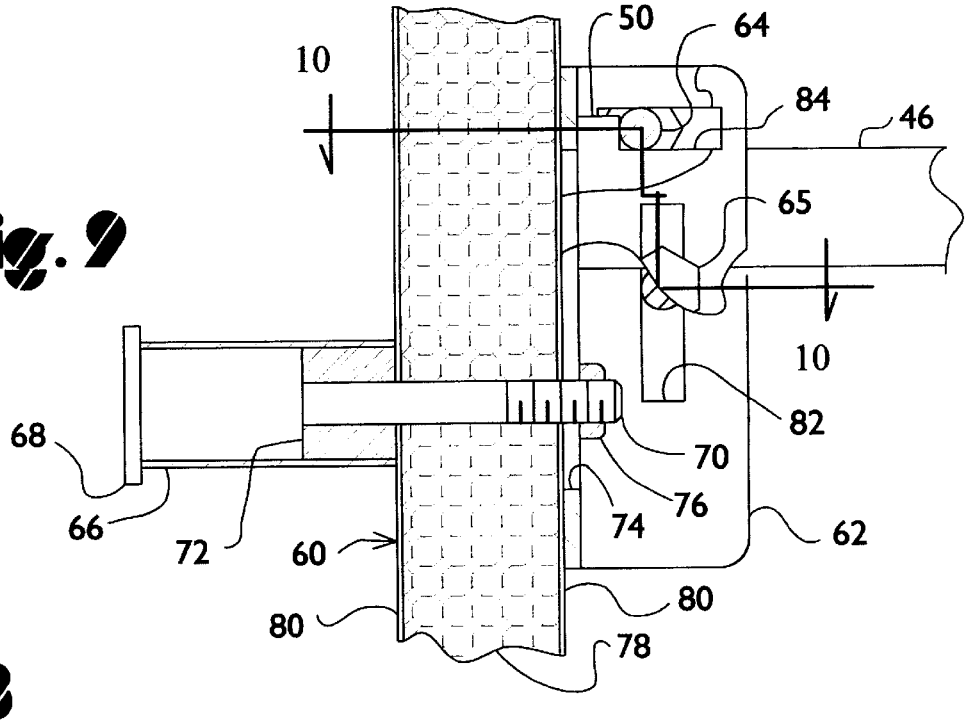
fig. 8
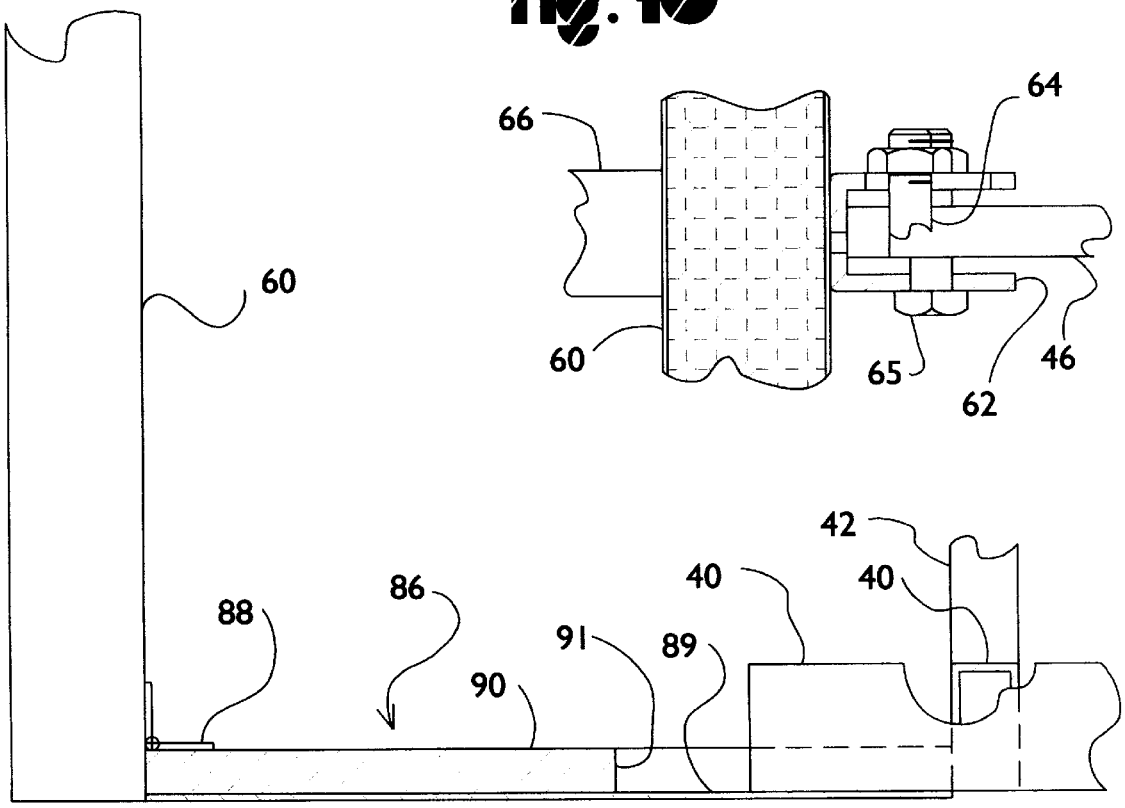
fig. 10

DISPLAY PANELS FOR RETAIL MERCHANDISE FIXTURES

The present invention relates to improvements in retail merchandising, and more particularly to improvements in display panels that are employed to feature individual items, or otherwise promote the sale of merchandise.

One widely used type of merchandise fixture is of the free standing type, which is provided with hanger arms on which merchandise, usually clothing of one form or another, is hung by conventional clothes hangers, to provide what is here referred to as a merchandise inventory. One of the basics of effective merchandising is to maintain as large an inventory of merchandise on the sales floor, as possible.

Relatively recently, it has been discovered that the use of display panels can also be an effective marketing tool. The display panels enable a single garment, or a small number of items, to be featured and more attractively presented than when is squeezed between other garments on a hanger arm. Most desirably, such display panels should be mounted directly on the merchandise fixture on which the displayed goods are inventoried. However, this marketing tool has had relatively little utilization, because conventional approaches to mounting a display fixture have caused the loss of either 25% or 50% of the inventory capacity of a merchandise fixture, depending on whether it is a four way fixture, having four hanger arms, or a two way fixture having two hanger arms.

Accordingly the object of the present invention is to enable the use of display panels, with little or no loss of merchandise inventory capacity, by the fixture on which the panel is mounted.

Another object of the present invention is to accomplish the foregoing ends in an economical fashion and in a manner that enables the panel to be used in combination with a wide variety of two way and four way fixture designs.

In accordance with the broadest aspects of the invention, the foregoing ends are attained by positioning a display panel in a plane normal to a hanger arm of a fixture and closely spaced from its outer end. Then, by securing the upper end portion of the display panel to the outer end of the hanger arm, and anchoring the lower end of the panel relative to the fixture with the panel in a vertically oriented position, there is little or no loss of inventory capacity of a fixture.

In accordance with a more specific feature of the invention, the display panel is provided with a peg on which display garments may be hung. The peg has a bolt that extends through the thickness of the display panel. The means for securing the upper end portion of the display panel to the hanger arm includes a bracket that has an opening through which the peg bolt passes. A nut threaded onto this bolt then provides means for mounting both the bracket and the peg on the display panel. Preferably the opening in the bracket is a slot, permitting the securing means to be vertically adjusted.

Another feature of the invention is found in means for securing the panel to the hanger arm, wherein a vertically adjustable positioning means engages a lower surface of the hanger arm and positions its upper surface against a horizontal positioning means, and the horizontally adjustable means engages a projection on the outer end of the hanger arm.

An alternate feature is the provision of means for securing the panel to the hanger arm, which comprises a bracket, a fixed abutment, and means for clamping the hanger arm against the fixed abutment.

Another feature of the invention is found in providing a positioning plate for positioning the lower end portion of the panel relative to the fixture. The position plate is relatively thin and is disposed under at least a portion of the merchandise fixture, to provide the positioning function. The positioning plate may further comprise an upper, relatively thick panel, which is recessed to permit the fixture to rest upon the positioning plate. The positioning plate may be connected to the display panel by a hinge, which permits the positioning plate to be swung against the face of the display panel, to facilitate movement and storage. Alternatively, the positioning plate may be connected to the display panel by interdigitated means that readily separate to permit the use of different positioning plates for different styles and types of hangers. This feature enables the use of positioning plates, which are customized so that the recess in the upper panel matches the configuration of the fixture base portion, that is to be received therein.

As an alternative to a positioning plate, a positioning arm may be employed to position the lower end of the display panel relative to the base of a fixture. This approach is best suited for four way fixtures, which have bases formed by tubular bars. The positioning arm is pivotally mounted on the display panel and, at its outer end, has a recess, which is received by the fixture base bar in performing the positioning function. Preferably, the length of the arm and the width of the recess are adjustable. Also there is a shaft, on the panel, on which the positioning arm is pivoted, and relative to which the positioning arm is laterally slidable, all to the end of enabling the display panel to be used in combination with wide range of merchandise fixture designs.

The above and other related objects and features of the invention will now be described in detail, with reference to the accompanying drawings, and the novelty thereof pointed out in the appended claims.

In the drawings:

FIG. 8 is a side view, on an enlarged scale and partially in section, of the lower end portion of the display panel shown in FIG. 7;

FIG. 9 is a section, on an enlarged scale, taken on line 9—9 in FIG. 6;

FIG. 10 is a section taken generally on line 10—10 in FIG. 9;

FIG. 13 is a horizontal section taken of a modified display panel, illustrating an alternate means for positioning the lower end of the display panel, relative to a two way merchandise fixture;

FIG. 14 is a section taken on line 14—14 in FIG. 13;

Figure 1:
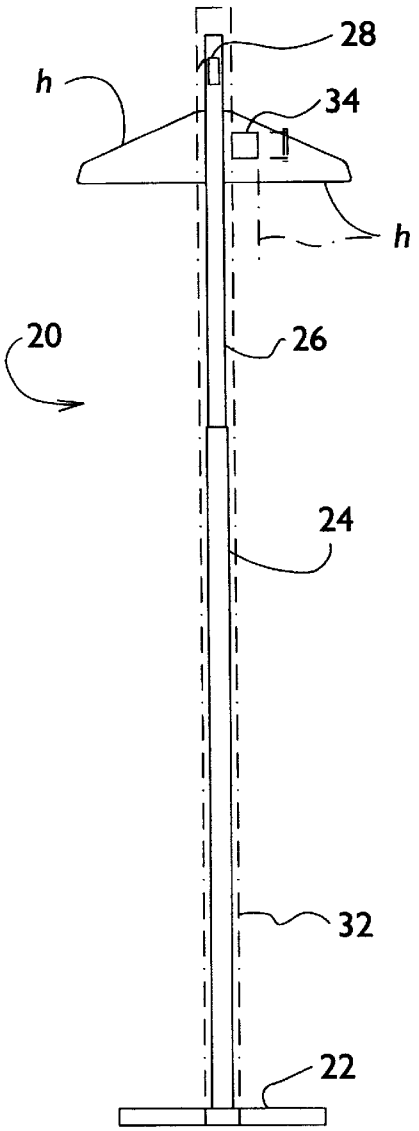
PRIOR ART fig. 1
FIG. 1 is a side view of a two way merchandise fixture, with a conventional display panel illustrate in phantom.

The two types of merchandise fixtures, to which the present invention relates, are shown, respectively, in FIGS. 1–3 and FIGS. 4, 5. The two way fixture, seen in FIGS. 1–3 and generally indicated by reference character 20, comprises a base plate 22 and a centrally positioned, upright, tubular column 24. A pair of posts 26 are mounted in the column 24. Support arms 28 are provided, respectively, on the posts 26, and extend outwardly, in opposite directions. In normal use, the full length of both arms is available to receive hangers h, with the arms having upstanding lugs 30, at their outer ends, to prevent the hangers from falling off the arms. The posts are usually vertically adjustable so that the arms can be positioned at a height of some four to five feet above floor level, as may be deemed best for the particular goods that are being sold at a given time.

This type of stand alone fixture has been an effective merchandising device for items, such as dresses, shorts, shirts and the like, because they are on hangers, can be removed from the display fixture for inspection, and then readily returned to the fixture. The fact that the arms project in a fashion that makes them accessible from either side contributes to the readiness with which the hanger mounted garments can be removed from or returned to the hanger arms 28. Because of the ease with which this can be done, customers, more often than not, will voluntarily return items to the fixture, when they are not what was wanted. This is a significant factor in maintaining a neat appearance in the sales display area, with a minimum of effort on store personnel.

There is a drawback to this type of merchandise fixture in that the items, when hung on the fixture, are not displayed in a manner which would best demonstrate their styling features, and thereby make them more attractive to potential purchasers. This drawback has led to the use of what are referenced as display panels, which serve as a back drop for one or more samples of the garments that are inventoried on the fixture. These display panels are generally in the order of five to six feet and 1½ to 2 feet in width. In most cases the width of the display panel at least approximates the breadth of a conventional clothes hanger, which is roughly 16 inches. A display panel of this size is effective in drawing the attention of potential customers to a single garment that is hung by a hanger, on a peg that projects outwardly from the panel.

Figure 2:
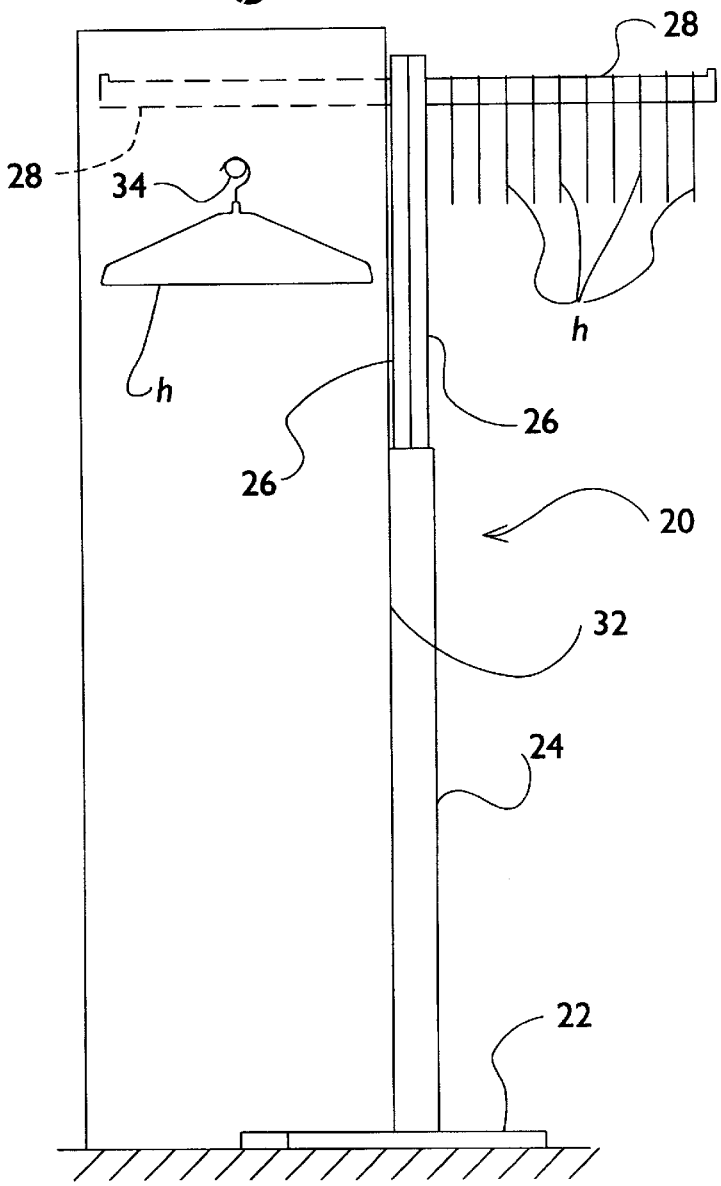
FIG. 2 is a front view of the two way fixture, with the conventional display panel mounted thereon.
Figure 3:
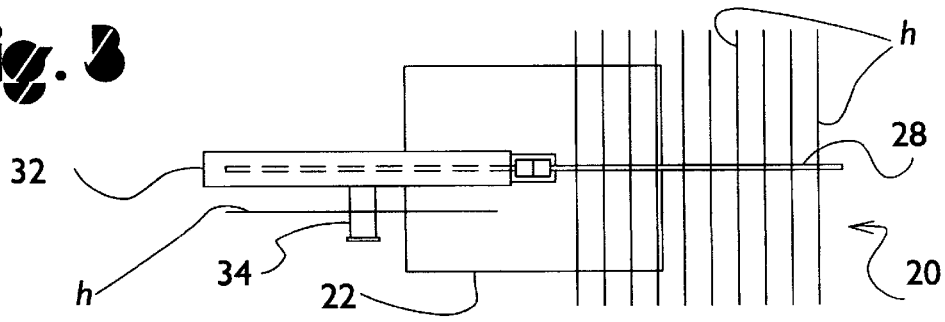
FIG. 3 is a top view of the two way fixture and conventional display panel.

In order to minimize confusion as to the location of merchandise, it is preferred that the display panel be associated directly with the fixture on which the displayed merchandise is inventoried. FIGS. 1–3 illustrate the conventional manner of mounting a display panel, indicated generally by reference character 32, on the two way fixture 20. Typically the display panels comprise an expanded polystyrene core, having a thickness in the order of two inches. The outer surfaces of the cellular polystyrene core are covered with a decorative, paper, or other veneer. This type of display panel weighs only a few pounds so that it can be readily positioned and moved for use in various types of merchandising schemes and still have sufficient ruggedness to withstand abuse and, therefore have a long wear life. All of these advantages are available at a modest cost.

As illustrated, one prior practice has been to form an opening which extends laterally from a side of the display panel. The panel is then telescoped over one of the arms 28 of the two way fixture, with the arm 28 received in the lateral opening. A step may then be formed in the lower end of the panel 32, so that the panel can rest on the display room floor, with its inner portion overlying the base 22. A peg 34 projects from a front face of the panel adjacent its upper end and centrally thereof. A garment, which would be representative of what is inventoried on the other arm 28, is then hung on the peg 34. The display panel thus focuses attention on the garment which is effectively displayed by being hung on the peg 34. Potential buyers are thus drawn to the merchandise that is hung on the one arm 28.

In an alternate approach to mounting display panels, the panel is likewise mounted parallel to the hanger support arm 28. However, instead of providing an opening in the side of the panel, to receive the arm 28, brackets are provided on the rear surface of the panel to clamp that surface against the length of the arm 28.

Figure 4:
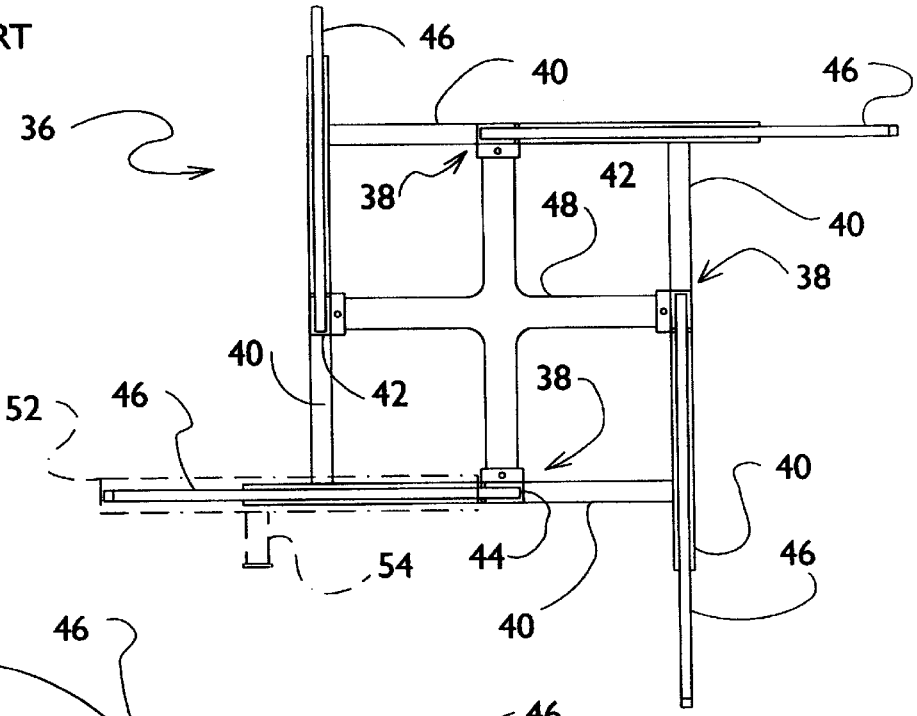
FIG. 4 is a partial plan view of a four way merchandise fixture, with a conventional display panel illustrated in phantom.
Figure 5:
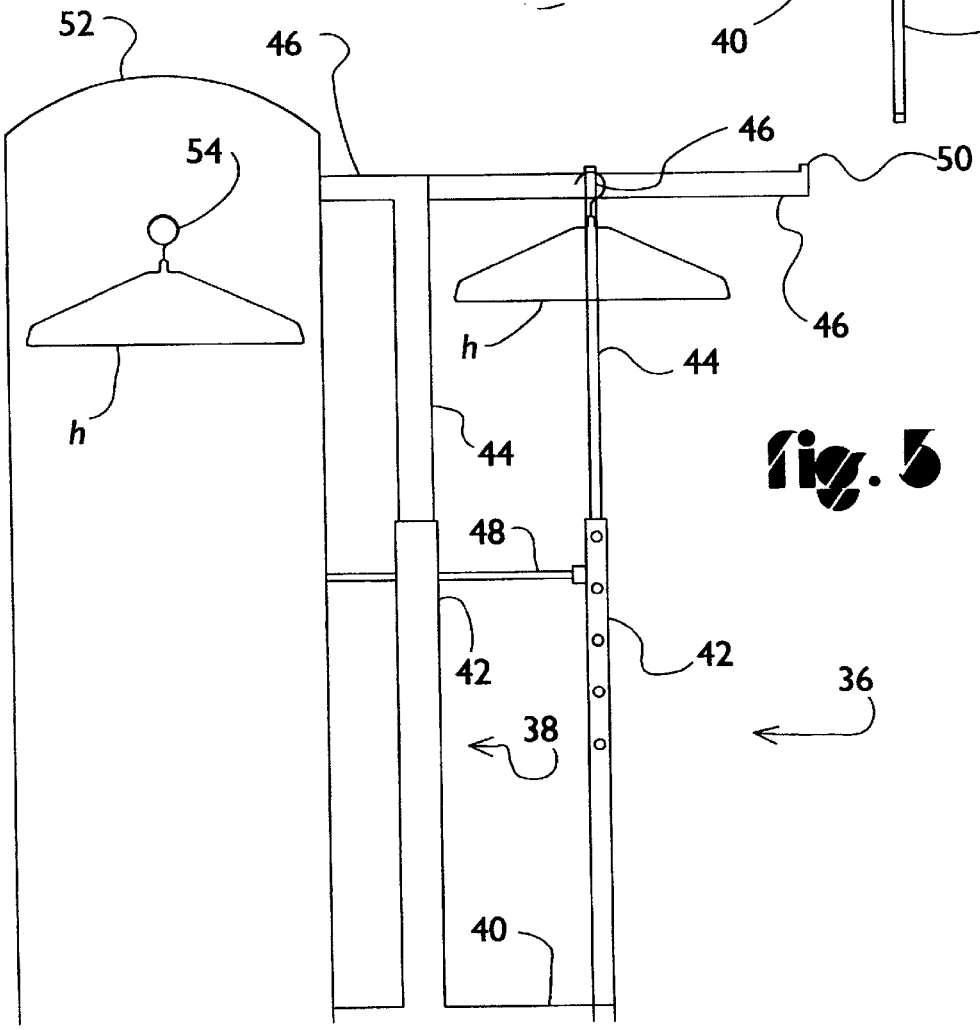
FIG. 5 is an elevation of the four way fixture, illustrating the conventional display mounted thereon.

Reference is next made to FIGS. 4 and 5 for a detailed description of a typical, four way merchandise fixture, which is generally identified by reference character 36. This fixture comprises four, inverted, T-shaped members 38, preferably formed by a square, tube fabrication. The transverse portions 40, of the T-shaped members are asymmetrical, with respect to their vertical stems 42 and are joined to form a square base frame, with the vertical stems of opposite T-shaped members being aligned and with the longer portion of each of the base members projecting from each corner of the square frame. The vertical stems 42 correspond to the columns 24 of the two way fixture, with each receiving a post 44, that is vertically adjustable relative thereto. At the upper end of each of the posts 44 is a laterally extending arm 46, that is vertically aligned with the underlying transverse frame portion 40 and in overlying relation to the longer portion of that frame portion. A spider 48 connects the upper ends of the vertical stems 42, to provide rigidity to the assembled four way frame.

Garments, or the like are mounted on the arms 46 by conventional hangers, as in the previously described two way fixture. Again, lugs (50) are provided at the outer ends of the support arms (46) so that a large number of items may be hung on the arms, without falling off. The name four way fixture is based on there being four arms 46 on which hangers may be hung. Correspondingly, the two way fixture 20 is so-called by reason of there being two arms 28 on which garments can be inventoried.

The need for and desirability of providing a display panel for a four way fixture is the same as for the two way fixture. Likewise, the conventional approach for mounting a display panel on a four way fixture is virtually identical with that employed for a two way fixture. Thus a panel 52 has a lateral slot which permits it to be telescoped over one of the arms 46. The lower end of the panel 52 may then be recessed to receive the underlying portions of the transverse frame members (40). A peg 54 projects, as in the previous panel, from a front face of the panel 52 to permit a garment to be hung thereon and thus to attract potential customers to the merchandise inventoried on the four way fixture 36 in the same fashion as the display panel for the two way fixture 20.

Unfortunately, there is a very heavy penalty paid when display panels are employed in accordance with these prior art teachings, specifically, there is a loss in merchandising inventory. It is fundamental to obtaining high sales volumes that the quantity of goods actually on the sales floor be maximized, in order that a potential purchaser will immediately be able to find the size that is needed, as well as to have the broadest available choice in style of a particular item or garment. This objective is drastically compromised when a display panel is employed with a two way merchandise fixture, in that the merchandising inventory is reduced by 50%. Since one of the two arms on which garments could be hung, is no longer available. From a practical standpoint, the use of display panels on two way fixtures is limited to high end, high markup merchandise. The situation is somewhat better with a four way fixture, but, even so, there is a 25% loss in merchandising inventory, when a display panel is conventionally provided.

Figure 6:
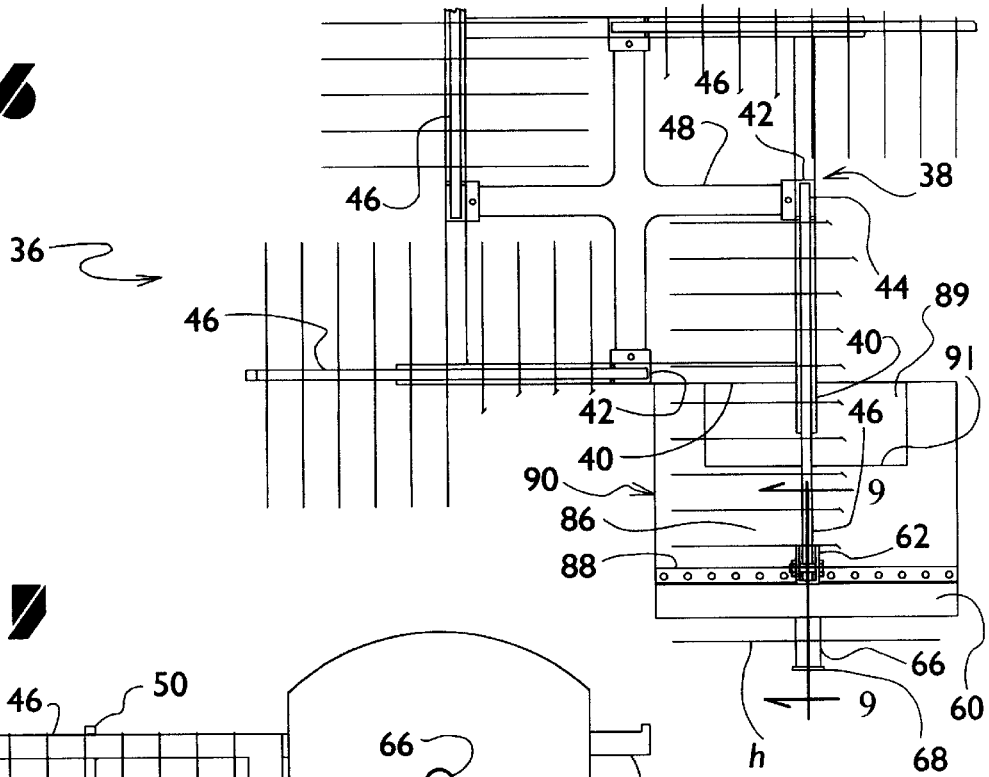
FIG. 6 is a partial plan view of a four way fixture, in combination with the display panel of the present invention.
Figure 7:
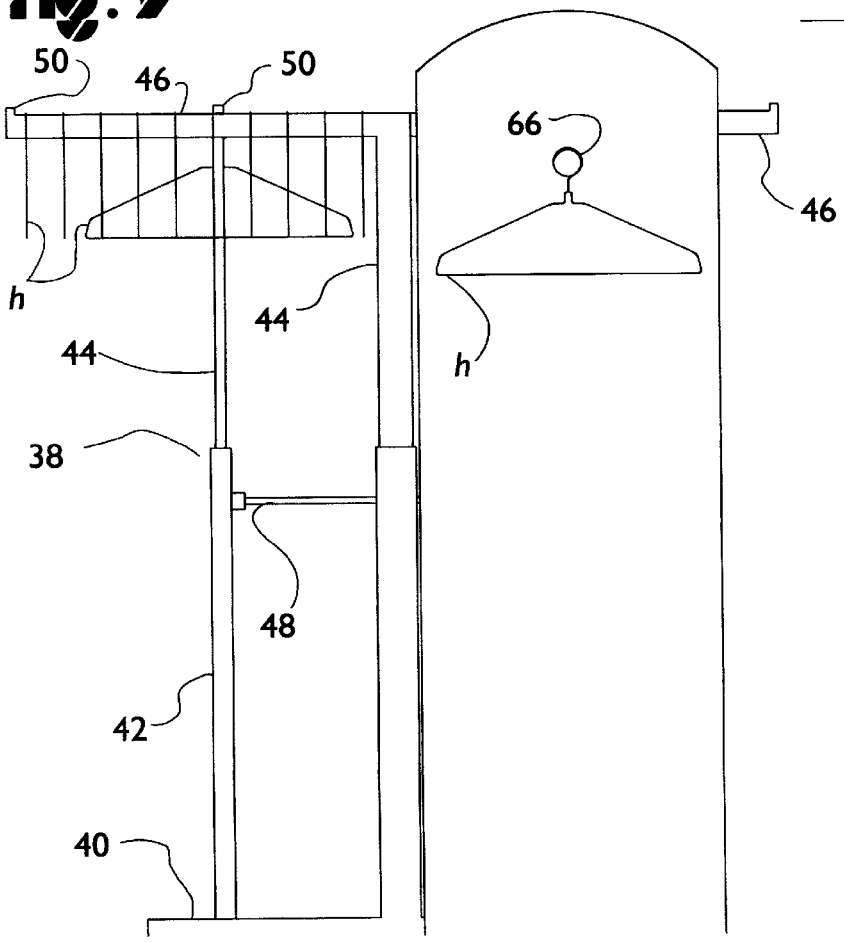
FIG. 7 is a elevation of the four way fixture and display panel of the present invention.

The loss of merchandising inventory is virtually eliminated by providing display panels in accordance with the construction shown in FIGS. 6 and 7, where a display panel 60 is mounted on a four way merchandise fixture, which may be the same as the previously described fixture 36. This fixture is identified with like reference characters and requires no further description.

The upper end portion of the display panel is secured to the outer end of one of the hanger arms 46, by releasably locking means that comprises a U-shaped bracket 62 (FIGS. 9 and 10) and a pair of locking screws, 64, 65. As in the conventional display panels, a peg 66 is provided to enable a garment to hung in front of the display panel. Advantageously, the peg 66 may be in the form of a sheet metal tube have an enlarged, outer rim 68, that prevents the displayed garment from inadvertently falling from the peg. The peg 66 has a bolt 70 projecting from its inner end, through the thickness of the display panel. Preferably, the bolt 70 is locked into a resinous plug 72 that is molded into the inner end portion of the peg 66. The bolt 70 extend through a vertically extending slot 74 in the U-shaped bracket 62. A nut 76, threaded onto the bolt 70, clamps the bridge of the U-shaped bracket 62 against the inner face of the display panel 60, as the hanger peg 66 is secured to the display panel.

FIGS. 9 and 10 also illustrate the foamed core construction of the display panel, with the core being indicated by reference character 78 and the laminated, decorative veneers by reference character 80.

Four way merchandise fixtures have been in widespread use for many years and have been produced by various manufacturers. Accordingly, from fixture to fixture, there can be dimensional variations in the length, width and height of the hanger arm (46), as well as variations in the height of the hanger arm above floor level. While most hanger arms are adjustable, there no one height to which the hanger arms of all fixtures can be adjusted.

The mechanism for securing the display panel to the hanger arm is capable of accommodating a wide range of variation in these dimensions. Thus, in establishing this connection, the bracket 62 may first be mounted on the end of the hanger arm by positioning the screw 65 in vertical bracket slots 82 so that it engages the lower surface of the arm and then causes the upper surface of the arm to engage the screw 64. The screw 64 is then positioned in the horizontal, bracket slots 84 so that it engages the arm projection 50 and positions the end of the arm 46 against the inner surface of the bridge of the bracket 62. The display panel may then be positioned adjacent the hanger arm and the bolt inserted through the bracket slot 74 and the nut 76 tightened so that the panel is attached to the hanger arm, in an upright position.

The lower end of the display panel is positioned relative the merchandise fixture by a position plate 86, which is secured to the panel 60 by a piano hinge 88 (FIG. 8). The positioning plate 86 is compositely formed by a relatively thin metal plate 89, and a relatively thick, wooden, or resinous the metal plate 89 is attached to the undersurface of the panel 90. The panel 90 has a recess 91, which permits a portion of the fixture frame 40 to extend into overlying relation with the metal plate 89. The weight of the fixture, bearing against the metal plate 89 is sufficient to prevent the lower end of the display panel from being inadvertently displaced, thereby providing the positioning function of maintaining the display panel in a desired, vertical position.

The thicker panel 90 reenforces the metal plate 89 so that it can have a minimum thickness. This is to note the plate 86, since it underlies one corner of the four way fixture, tends to tilt the merchandise fixture. With this minimum plate thickness, tilting of the fixture is inconsequential since, in most cases, the sales floor will be carpeted to the end that the fibers of the carpet will be preferentially displaced so that any tendency for the fixture to tilt will be minimized and, from a practical standpoint, there will be no noticeable tilting.

The thicker panel 90 also serves a cosmetic function, in that it can be surfaced with the same laminate as employed on the display panel, as well as providing protection against injury if the edge of the thin, positioning plate, were struck by someone wearing a soft shoe. It will be further appreciated that the recess 91 has a width and depth sufficient to receive the rectangular end of the base of a two way fixture, in the fashion indicated in FIG. 13, in connection with another embodiment of the invention. This brings out the fact that the present embodiment of the positioning plate is "universal" in that finds equal utility with either a two way fixture, or a four way fixture, as well as with a range of dimensional variations in both styles of fixture.

Figure 11:
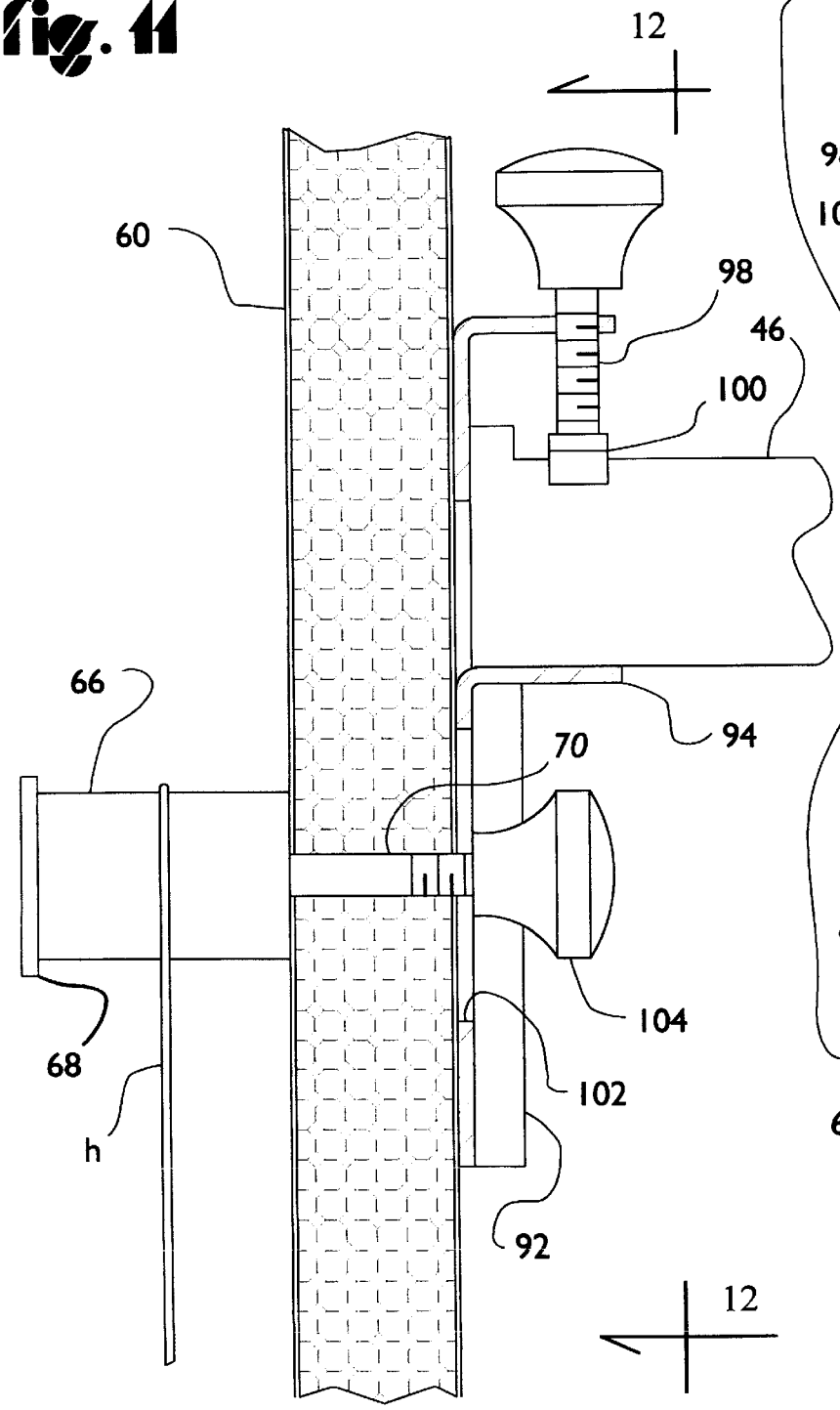
FIG. 11 is a vertical section, similar to FIG. 9, illustrating an alternate mechanism for securing the display panel to the hanger arm of a merchandise fixture.
Figure 12:
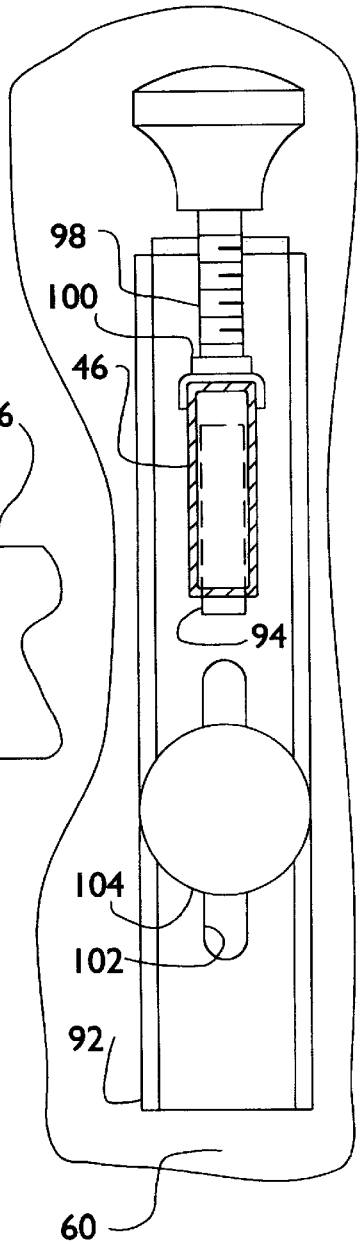
FIG. 12 is a section taken on line 12—12 in FIG. 12.
Figure 43:
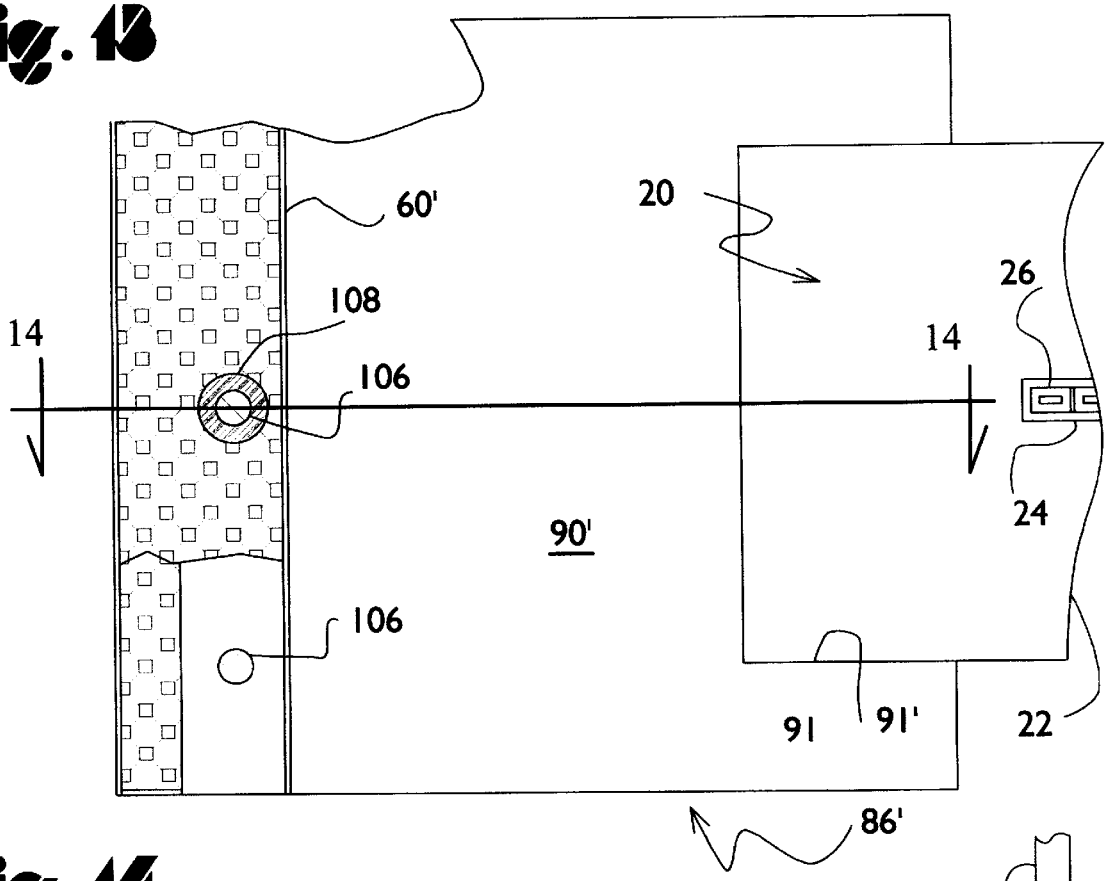
Figure 44:
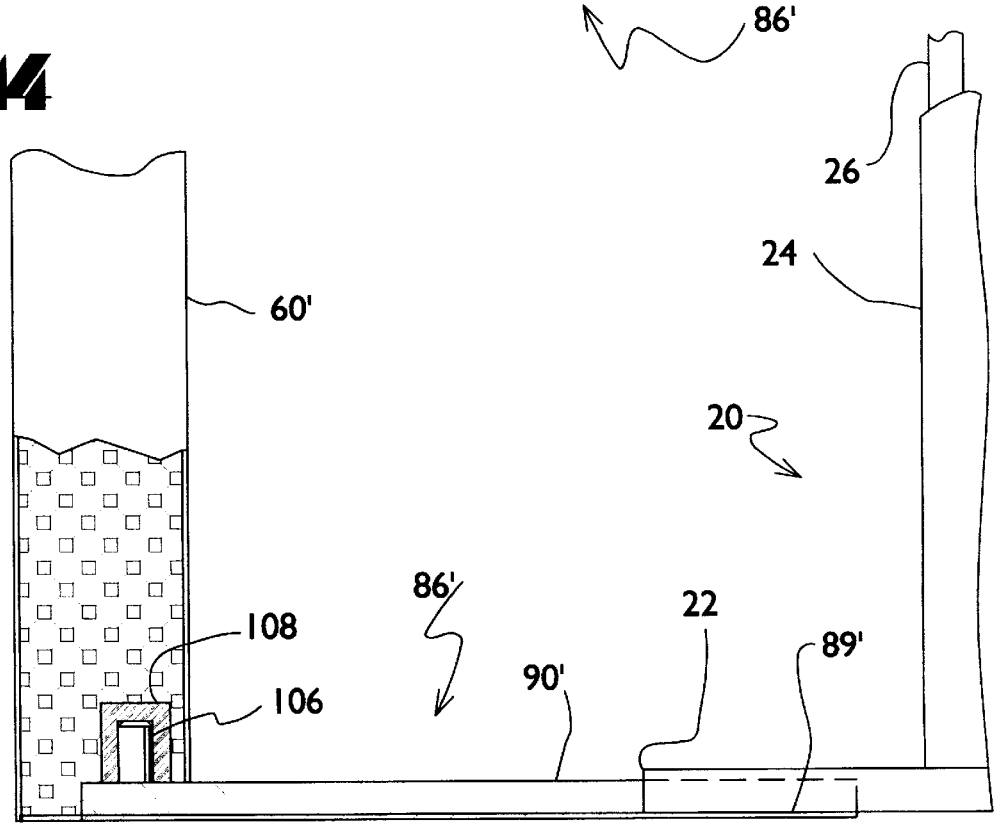

FIGS. 11 and 12 illustrate an alternate mechanism for securing the upper end portion of the display panel 60 to the outer end of a hanger support arm 46. The previously described hanger peg 66 and mounting bolt 70, which projects through the display panel, may also be employed as a part of this attaching mechanism. The alternate mechanism comprises a U-shaped bracket 92 having a positioning tab 94 displaced from its bridge. A tab 96, at the upper end of the bracket's bridge, is bent into overlying relation to the positioning tab 94. A locking screw 98 is threaded through the tab 96. A centralizing clamp 100, is provided at the lower end of the screw 98 to centrally position the bracket 92 relative to the hanger arm 46, as the screw 98 is rotated to clamp the arm 46 against the fixed abutment provided by the positioning tab 94. Preferably, the outer end of the arm 46 is engaged with the inner surface of the bridge bracket in this clamped position.

Once this bracket 92 is so clamped on the hanger arm 46, the locking bolt 70 may be inserted through a slot 102, formed in the bridge of the bracket, as illustrated in FIG. 11. A nut 104 is then threaded onto the bolt 70, to clamp the bracket 92 against the inner surface of the panel 60, as the peg 66 is secured in place on the display panel 60. It can be seen that the nut 104 is in the form of a relatively large knob and that a relatively large knob is provided at the upper end of the clamping screw 98. These large knobs facilitate attachment of the panel 60 to the hanger arm 46, without the need for a separate tool, such as a wrench or screw driver.

FIGS. 13 and 14 illustrate an alternate approach to positioning the lower end of a display panel relative to a merchandise fixture. The first described positioning plate 86 was secured to the display panel 60 by the piano hinge 88 (FIGS. 6 and 8). The hinge attachment of the positioning plate has the advantage making the display panel a single, articulated unit. The positioning plate can be folded against the surface of the display panel, so that the unit can be readily stored, with a minimum space requirement, while, at the same time, there is no possibility of the positioning plate becoming separated from the display panel and then misplaced.

The positioning plate 86' of FIGS. 13 and 14 serves the same purpose and function as the positioning plate 86, differing in that is removably connected to a modified display panel 60', by interdigitated means comprising three upstanding pins 106, that are, respectively received in sockets 108, that are embedded in the foamed core 78' of the panel 60'. The lower surface of the panel 60' is rabbetted so that the lower surface of the panel and the lower surface of the positioning plate 86' are on a common plane and will be equally supported on the floor of a sales room, when the display panel is in use. The positioning plate 86' is also compositely formed, comprising an upper panel 90' a metal plate 89' that underlies the merchandise fixture and actually performs the positioning function.

In contrast to the "universal" positioning plate 86, previously described, the removable feature of the alternate positioning plate 86' enables the positioning plate being used, to be customized for the specific type of fixtures with which the display panel is being used. Thus, the recess 91' is dimensioned so that the base 22 of the two way fixture 20 is snugly received therein, when the display panel is disposed in a vertical position and attached to the outer hanger arm of that fixture. If a display panel is to be provided for a four way fixture, then a positioning plate, intended for use with that four way fixture, would be substituted for the positioning plate 86. The positioning plate used with a four way fixture would have a recess (91) in the upper plate (90), that would match the vertical outline of the projecting frame member 40. Not only does this customization of the positioning plate recess enhance the aesthetic appearance of the display panel, it eliminates any recesses that could trap scraps of paper or other trash, further contributing to an enhanced appearance of the display.

Figure 15:
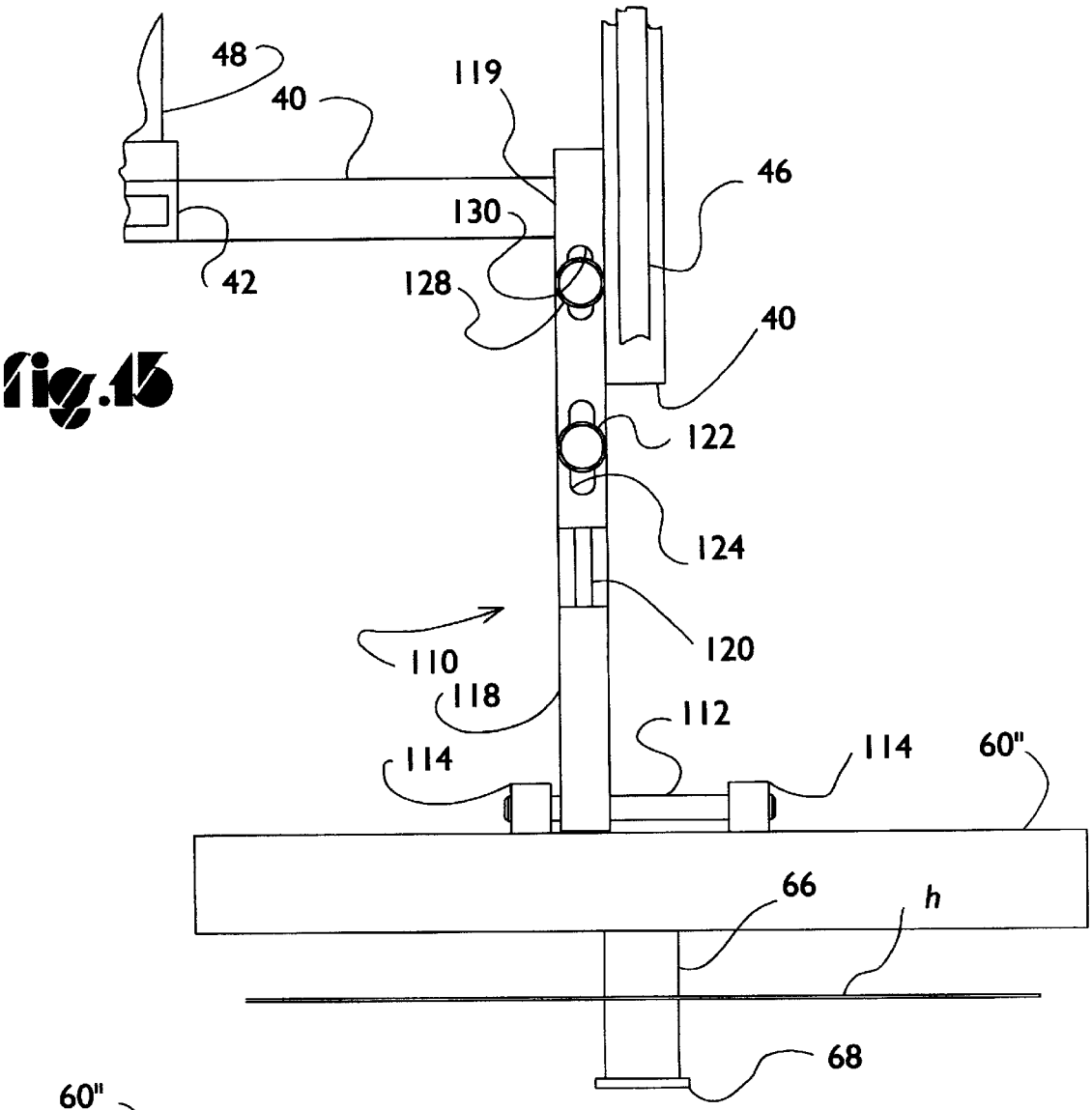
FIG. 15 is a partial, fragmentary plan view of a four way merchandise fixture illustrating another mechanism for portioning the lower end of the display panel relative to this type of fixture.
Figure 16:
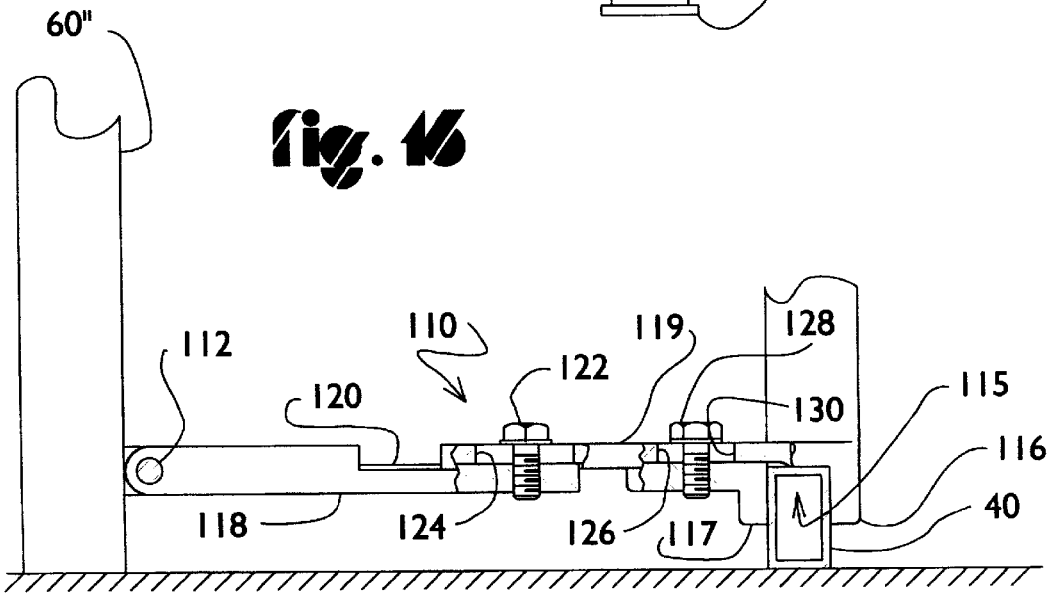
FIG. 16 is a side elevation of the lower end portion of the display panel and the positioning mechanism seen in FIG. 15.

FIGS. 15 and 16 illustrate yet another approach to locating the lower end of a display panel. The locating means of this embodiment are specifically intended for use in combination with merchandise fixtures, of a type which include a base that is formed by relatively narrow bars. The four way fixture 36, previous described, is representative of this type of fixture, in that the base of the fixture is formed by the four frame members 40.

A modified display panel 60" is employed, using the attaching means of either FIG. 9 or FIG. 11, to secure the upper end of the panel to the outer end of one of the hanger arms 46. The lower end of the display panel 60" is then positioned, in a vertical position, by a positioning arm 110, which is pivotally mounted on a shaft 112. The shaft 112 extends between lugs 114, that are mounted on the display panel 60". The positioning arm is provided with a recess 115, formed by a pair of opposed, locating members 116, 117, which embrace the adjacent frame member 40, thereby positioning the lower end of the display panel to maintain the desired, vertical position of the display panel 60".

The positioning arm 110 may be compositely formed by an inner end portion 118, and an outer end portion 119. A longitudinal rib 120, on the inner portion 118 is received by a corresponding groove in the lower surface of the outer positioning arm portion 118 to maintain the end portions in alignment. The positioning arm portions 118, 119 are maintained in assembled relation by a screw 122 that extends through a slot 124 in the outer arm portion 119, and is threaded into the inner arm portion 118. This composite construction permits the effective length of the positioning arm 120 to be adjusted to a length, which will properly position the display panel. By providing means for adjusting the effective length of the positioning arm, it is possible for the display panel to be used with a wide variety of merchandise fixtures, specifically enabling the display panel to be used with fixtures in which the horizontal distance between the outer end of the hanger arm and the base of the fixture is a variable.

The spacing between the locating members 116, 117 is also adjustable in order to adjust the width of the recess 115, so that panel 60" can be used with fixtures having frame members of different thicknesses. To this end, the locating member 117 is formed integrally with and depends from a slide 126. A rib is also provided on the upper surface of the slide 126, and received in the same groove that receives the rib 120. The slide 126 is clamped to the outer arm portion 119 by a screw 128 that extends through a slot 130 in the outer arm portion 119, and is threaded into the slide. The slide 126 and thus be adjustable to properly space the locating members 116, 117 for the thickness of the frame member of a given design and manufacture.

Another variation in merchandise fixture design is found in the direction which the free ends of the frame portions 40 are pointed. Referencing FIG. 4, the free end of the lower end of the frame member 40 projects to the left, or in a clockwise direction. The right hand frame member 40, in FIG. 15 points downwardly, also in a clockwise direction. This type of fixture can also be formed by T-shaped frame members, with the opposite ends of the horizontal frame portions being the longer and extending, relative to the adjacent T-shaped member, in the opposite direction, which would be a counter-clockwise direction.

To accommodate this style of fixture, the positioning arm 110 is slidable on the shaft 112 so that it could be positioned on the opposite side of the right hand frame member 40, when the adjacent frame portion 40, is on its opposite, or "counter-clockwise" orientation. It will also be noted that the spacing between the shaft-mounting lugs 114, is sufficient to permit the positioning arm outward, in case the width of the frame member 40 is greater than what is shown. The addition room for lateral adjustment enables the positioning arm to be maintained at right angles to the frame member that is being gripped.

Again, the several embodiments all facilitate the provision of a display panel which is removably mounted on a merchandise fixture, with the panel disposed at the end of a merchandise hanger arm, and with the panel disposed in a plane normal to the hanger arm. This merchandising display provides the advantages of a display panel backdrop for featuring a single item (or a relatively few items), to thereby increase the effectiveness with which the item is displayed, all to the end of enhancing sales.

It is to be noted that the display panel (60) of the several embodiments is both rigid and light weight so that is has the further advantage of being easily put in place or removed and stored, as the merchandising needs of a particular store may be at any given point in time. The cellular polystyrene core, with decorative laminates, serves very well, particularly in a thickness range of 1–2 inches. However, other lightweight constructions could also be used, as molded plastic shells that are joined to form a panel.

In summary, the present invention significantly increased the merchandise fixtures, by mounting a display panel by positioning a display panel in a plane normal to the hanger arm and closely spaced from its outer end. Then, by securing the upper end portion of the display panel to the outer end of the hanger arm, and anchoring the lower end of the panel relative to the fixture, with the with the panel in a vertically oriented position, there is little or no loss of inventory capacity.

Having thus described the invention, what is claimed as novel and desired to be protected by Letters Patent of the United States is:

1. A merchandising display panel configured to be attached to a merchandise fixture, said merchandising fixture having a base, an upright member, and a cantilevered, hanger arm rigidly projecting from said upright member, said hanger arm being independently capable of supporting hangers on which merchandise is hung, said display panel being configured with a height adapted to at least approximate the height of the hanger arm, and a width adapted to at least approximate the width of a hanger, said display panel comprising means adapted to secure the upper end portion of the panel to the outer end of the hanger arm, with the width dimension of the panel normal to the longitudinal direction of the hanger arm, the means adapted to secure the panel to a fixture including a bracket mounted on said panel on an inner surface thereof, which surface is adapted to face towards the fixture to which the panel is to be attached, and means adapted to connect the outer end of the hanger arm to the bracket, and means adapted to position the lower end of the panel, relative to the fixture, with the panel in a vertically oriented position, whereby, the display panel may be attached to a merchandise fixture, with little or no reduction in the inventory of goods that can be displayed on the hanger arm to which the display panel is secured.

2. A merchandising display panel as in claim 1, further comprising a peg mounted on an outer surface of the display panel adapted to face away from the merchandise fixture, said peg being adapted to have a hanger hung thereon, thus enabling the features of an individual item to be more effectively presented to potential purchasers, and wherein the means adapted to secure the upper end of the display panel comprises a bolt, secured to the inner end of the peg, and extending through the display panel to an inner face of the panel, and means cooperating with said bolt for clamping the bracket to the inner face of the display panel, said clamping means also simultaneously securing said peg on the display panel.

3. A merchandising display panel as in claim 2, wherein the bracket has a U-shaped configuration, and the bridge of the bracket is vertically disposed and clamped against the inner surface of the display panel, and the means adapted to connect the hanger arm, are mounted on the U-shaped bracket, and the panel further comprises means for adjusting the vertical height of the U-shaped bracket, relative to the display panel.

4. A merchandising display panel as in claim 2, wherein the means adapted to secure the panel to the hanger arm includes means adapted to clamp the outer end of the hanger arm in fixed relation relative to said bracket.

5. A merchandising display panel as in claim 1, which is configured to be attached to a merchandise fixture in which the hanger arm has an upwardly projecting stop at its outer end, and the means adapted to connect the arm to the bracket comprises horizontally adjustable positioning means adapted to engage the upper surface of the hanger arm and capture the hanger arm stop between the horizontally adjustable means and the bracket, and vertically adjustable positioning means adapted to engage a lower surface of the hanger arm and position an upper surface of the hanger arm in engagement with the horizontally adjustable means.

6. A merchandising display panel as in claim 5, wherein the bracket is a U-shaped bracket, the bridge of which is clamped against the inwardly facing surface of the display panel, and the horizontally adjustable means comprise a bolt, that extends through horizontal slots in opposed leg portions of the U-shaped bracket, and the vertically adjustable means comprise a bolt, that extends through vertical slots in opposed portions of the U-shaped bracket.

7. A merchandising display panel as in claim 6, further comprising a peg mounted on an outer surface of the display facing away from the merchandise fixture, said peg being adapted to have a hanger hung thereon, thus enabling the features of an individual item to be more effectively presented to potential purchasers, and a bolt secured to the inner end of the peg, and extending through the display panel to an inner face of the panel, and wherein the bridge of the U-shaped bracket has a longitudinal slot through which the peg bolt extends, and a nut is threaded onto the peg bolt to clamp the bracket against the panel and secure the peg to the display panel.

8. A merchandising display panel as in claim 1, wherein the means adapted to connect the arm to the bracket further comprises a fixed abutment on the bracket adapted to engage one of an upper surface and a lower surface of the hanger arm, and means adapted to engage the other of said upper and lower hanger arm surfaces, and to clamp the hanger arm against the fixed abutment.

9. A merchandise display panel as in claim 8, wherein the bracket is a U-shaped bracket, the fixed abutment comprises a tab bent outwardly from the U-shaped bracket and is adapted to underlie the hanger arm, a second tab is bent from said bracket in overlying relation to said fixed abutment, and the means adapted to engage the other of said hanger arm surfaces is a screw threaded through the second, bracket tab, and is adapted to engage an upper surface of the hanger arm, and clamp the hanger arm against the fixed projection.

10. A merchandising display panel as in claim 9, further comprising a peg, projecting outwardly from a surface of the display facing away from the merchandise fixture, said peg being adapted to have a hanger hung thereon, thus enabling the features of an individual item to be more effectively presented to potential purchasers, and a bolt secured to the inner end of the peg, and extending through the display panel to an inner face of the panel, and wherein the bridge of the U-shaped bracket has a longitudinal slot through which the peg bolt extends, and a nut is threaded onto the peg bolt to clamp the bracket against the panel and secure the peg to the display panel.

11. A merchandising display panel as in claim 1, wherein the means adapted to position the lower end of the display panel comprise, a positioning plate connected to the display panel and having a portion that is adapted to underlie at least a portion of the base of the merchandise fixture.

12. A merchandising display panel as in claim 11, wherein, the positioning plate is compositely formed by a relatively thin plate that actually underlies the fixture, and a relatively thick panel, which overlies the relatively thin plate, said panel being recessed to permit the relatively thin plate to be in underlying relation to the fixture.

13. A merchandising display panel as in claim 12, wherein the positioning plate is connected to the display panel by a hinge, which permits the positioning plate to be laid flat against an inner face of the display panel, thereby facilitating moving and storage of the display panel.

14. Merchandising display panel as in claim 12, wherein the positioning plate is connected to the display panel by separable, interdigitating means, which permit the use of positioning plates that are, respectively, customized for the type of merchandise fixture, with which the display panel is being used.

15. A merchandising display panel as in claim 14, wherein the display panel comprises a foamed resin core, surfaced by a decorative laminate, and the interdigitating means comprise a plurality of pins extending upwardly from an end of the positioning plate remote from the merchandise fixture, and a plurality of solid resin sockets, embedded into the lower portion of the foamed resin core, and adapted to receive the positioning plate pins.

16. A merchandising display panel as in claim 1, wherein the means adapted to position the lower end of the display panel comprise, a positioning arm, means, mounted on the inner surface of the display panel, for pivotally mounting one end of the positioning arm, and means, mounted on an end of the positioning arm, distal of the pivotal mounting means, which are adapted to swing into and out of positioning relationship with the base of the fixture.

17. A merchandising display panel as in claim 16 which is configured to be attached to a merchandise fixture in which the fixture base includes a bar extending at right angles to the hanger arm and disposed adjacent the lowermost surface of the fixture, wherein the display panel further includes a horizontally disposed shaft mounted on and parallel to the display panel, and the positioning arm is pivotally mounted on the shaft, the positioning arm is slidable along the length of said shaft to permit is to be laterally shifted relative to the display panel, and the means adapted to be swung into and out of positioning relationship comprises a recess at the distal end of the position arm, that is adapted to receive said bar.

18. A merchandising display panel as in claim 17, wherein the positioning arm is longitudinally slidable on said shaft, means are provided for adjusting the length of the positioning arm, and means are provided for adjusting the width of the positioning arm recess, all to facilitate use of the display panel with merchandise fixtures of different styles and dimensions.

19. A merchandising display panel as in claim 1, further including means for adjusting the vertical position of the means adapted to secure the panel to the hanger arm so that the connecting means can be adjusted to cooperate with respect to height of hanger arm of varying height.

20. A method of providing a display panel for a preexisting, merchandise fixture having a base, an upright member, and a horizontal hanger arm rigidly projecting from said upright member, said upright member being independently capable of supporting hangers on which merchandise is hung, comprising the steps of positioning the display panel in a plane normal to the hanger arm and closely spaced from the outer end of the hanger arm, securing the upper end portion of the display panel to the outer end of the hanger arm, using means that are inclose proximity to the outer end face of the hanger arm and which cause no more than a minimal reduction in the inventory of merchandise that can be carried by said hanger arm, and anchoring the lower end of the panel relative to the fixture, with the panel in a vertically oriented position.

21. A method of providing a display panel for a preexisting, merchandise fixture as in claim 20 wherein the step of securing the display panel to the hanger arm includes releasably clamping the outer end of the hanger arm in fixed relation to the display panel.

* * * * *